US009752343B1

(12) United States Patent
Chapman et al.

(10) Patent No.: US 9,752,343 B1
(45) Date of Patent: Sep. 5, 2017

(54) ADJUSTABLE TOWER REINFORCEMENT AND STABILIZATION ATTACHMENT

(71) Applicant: Valmont Industries, Inc., Omaha, NE (US)

(72) Inventors: Brandon M. Chapman, Bourbon, IN (US); Kari A. Chittenden, Plymouth, IN (US)

(73) Assignee: Valmont Industries, Inc., Omaha, NE (US)

( * ) Notice: Subject to any disclaimer, the term of this patent is extended or adjusted under 35 U.S.C. 154(b) by 0 days.

(21) Appl. No.: 15/410,132

(22) Filed: Jan. 19, 2017

Related U.S. Application Data

(60) Provisional application No. 62/281,989, filed on Jan. 22, 2016.

(51) Int. Cl.

| | |
|---|---|
| ***E02D 37/00*** | (2006.01) |
| ***E04G 23/00*** | (2006.01) |
| ***E04H 12/10*** | (2006.01) |
| ***E04H 12/24*** | (2006.01) |

(52) U.S. Cl.
CPC ..... *E04H 12/10* (2013.01); *E04H 12/24* (2013.01)

(58) Field of Classification Search
CPC ... E04H 12/24; E04H 12/10; E04H 2012/006; E04B 1/1903; E04B 1/34384; E04B 1/585; E04B 2001/1957
USPC ..... 52/651.01, 652.1
See application file for complete search history.

(56) References Cited

U.S. PATENT DOCUMENTS

| | | | | |
|---|---|---|---|---|
| 4,772,894 | A * | 9/1988 | Foissac | E04B 1/34384 343/874 |
| 5,601,274 | A * | 2/1997 | Minor | F16F 13/00 248/219.1 |
| 7,574,832 | B1 * | 8/2009 | Lieberman | E04H 12/10 212/350 |
| 2004/0032375 | A1 * | 2/2004 | Ianello | E04H 12/10 343/890 |
| 2005/0001131 | A1 * | 1/2005 | Stevens | E04H 12/10 248/351 |
| 2012/0263545 | A1 * | 10/2012 | Oestergaard | E02B 17/00 405/227 |
| 2016/0168841 | A1 * | 6/2016 | Zhou | E04H 12/085 52/652.1 |

* cited by examiner

*Primary Examiner* — Brian Mattei
(74) *Attorney, Agent, or Firm* — Milligan PC LLO

(57) ABSTRACT

The present invention provides an adjustable bolt-on brace attachment for strengthening standard field irrigation towers and tapered sections of field irrigations towers to stabilize a tower. In one aspect of the present invention, an attachment for stabilizing field irrigation towers allows the user to easily assemble the adjustable bolt-on brace in the field wherein three threaded ¾ inch rods span between the each of the three weight bearing poles of the field irrigation system. Each ¾ inch threaded rod is spanned between each pair of weight-bearing poles of a tower attaching at each pole by a galvanized steel two-sided clamp which is double bolted-on to each pole. The adjustable threaded rods may span from 15 inches to 49 inches of each of three tower faces and adjustable double sided steel clamps fit field irrigations tower legs sizes from ⅞ inch to 2½ inches diameter.

1 Claim, 5 Drawing Sheets

View A-A

ADJUSTABLE TOWER REINFORCEMENT AND STABILIZATION ATTACHMENT

RELATED APPLICATIONS

The present invention claims priority to U.S. Provisional Application No. 62/281,989 filed Jan. 22, 2016.

FIELD OF INVENTION

The present invention is related in general to irrigation system towers and specifically to an attachment for stabilizing field towers under strong wind conditions.

BACKGROUND OF THE INVENTION

The structural components and stability of a field irrigation system can be greatly affected by strong winds and wind gusts. Currently, in strong winds conditions irrigation systems require monitoring and frequent adjustments. Further, under severe conditions, destabilization of the tower structures of the field irrigation system can occur resulting in buckling and/or torqueing of the entire field irrigation system damaging crops and equipment.

SUMMARY OF THE DISCLOSURE

The preferred embodiment of the present invention provides an adjustable bolt-on brace attachment for strengthening standard field irrigation towers and tapered sections of field irrigations towers to stabilize a tower.

In one aspect of the present invention, an attachment for stabilizing field irrigation towers allows the user to easily assemble the adjustable bolt-on brace in the field wherein three threaded ¾ inch rods span between the each of the three weight bearing poles of the field irrigation system. Each ¾ inch threaded rod is spanned between each pair of weight-bearing poles of a tower attaching at each pole by a galvanized steel two-sided clamp which is double bolted-on to each pole. The adjustable threaded rods may span from 15 inches to 49 inches of each of three tower faces and adjustable double sided steel clamps fit field irrigations tower legs sizes from ⅞ inch to 2½ inches diameter.

According to further embodiments of the present invention, one or more adjustable bolt-on brace attachments of the present invention may be used per irrigation field tower. According to at least one embodiment of the present invention, at least two adjustable bolt-on brace attachments of the present invention may be preferred.

Other goals and advantages of the invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

BRIEF DESCRIPTION OF THE DRAWINGS

Elements in the figures have not necessarily been drawn to scale in order to enhance their clarity and to improve the understanding of the various elements and embodiments of the invention. Furthermore, elements that are known to be common and well understood to those in the industry are not depicted in order to provide a clear view of the various embodiments of the invention. Thus, it should be understood that the drawings are generalized in form in the interest of clarity and conciseness.

DETAILED DESCRIPTION OF THE DRAWINGS

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
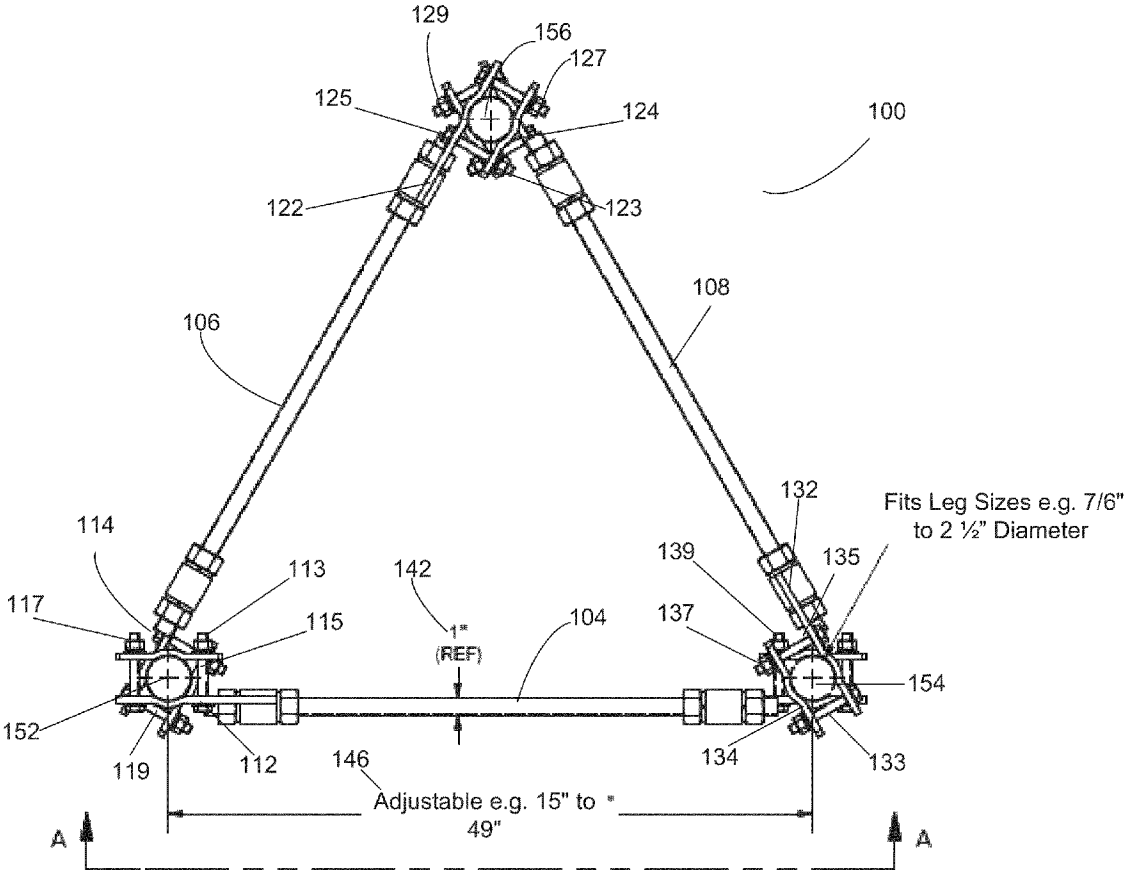
FIG. 1 illustrates a top view of an adjustable bolt-on-brace assembly of the present invention.

With reference now to FIG. 1 a top view of an adjustable bolt-on-brace assembly of the present invention will now be discussed. As shown in FIG. 1, an adjustable triangular bracing framework 100 wherein each side of the bracing framework is made of a threaded rod 104, 106, 108. Each threaded rod ends with a welded galvanized clamp 112, 114, 122, 124, 132, and 134. At the distal end of each thread rod, the galvanized clamps are welded as an extension of the vector of the threaded rod(s) 112, 122, and 132. Additionally, as further shown in FIG. 1, either the distal or proximate ends of each threaded rod may preferably be welded at a 60-degree angle 114, 124, and 134. According to a preferred embodiment of the present invention, each distal end of a threaded rod is bolted by means of two hexagonal bolts 113, 115, 117, 119, 123, 125, 127, 129, 133, 135, 137 and 139. According to one aspect of the present invention, the threaded rod 104 may have a diameter of ¾ inch and an adjustable length 146 in the range of 15-49 inches which may allow the user to attach the bracing framework at different levels of the legs to support the field irrigation tower. As shown in FIG. 1, a cut out of each of the legs of the tripod of an exemplary field irrigation tower are shown at item identifiers 152, 154 and 156 in which the adjustable triangular bracing framework may be attached at a plane perpendicular to the legs of the field irrigation tower.

Figure 2:
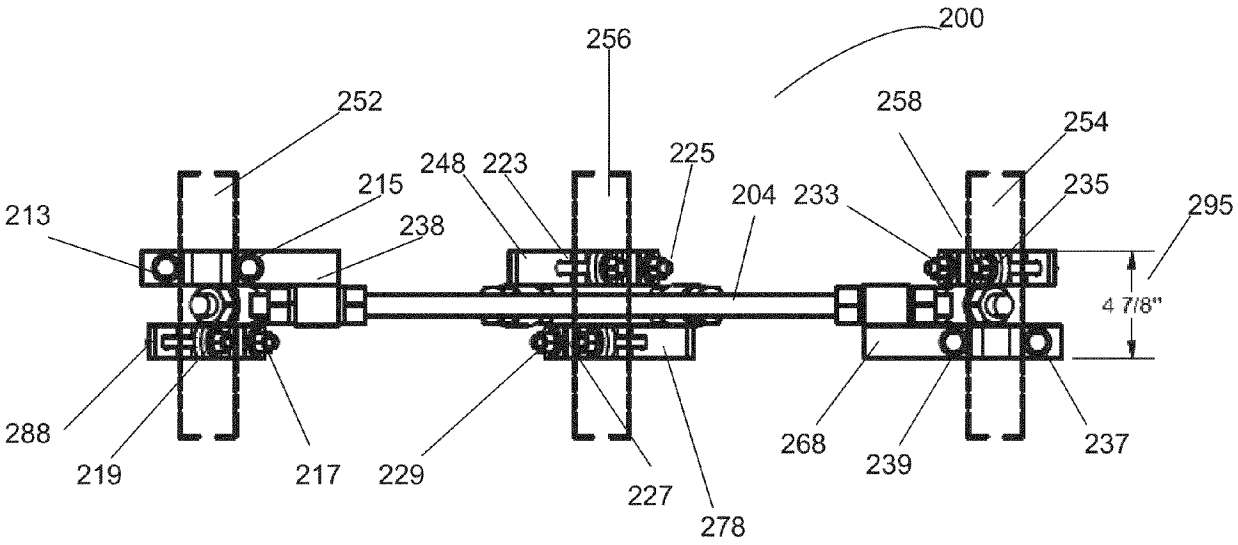
FIG. 2 illustrates a side view of an adjustable bolt-on-brace assembly of the present invention.

With reference now to FIG. 2, a side view of an adjustable bolt-on-brace assembly of the present invention will now be discussed. As shown in FIG. 2, the adjustable triangular bracing framework 200 is shown including six double bolted galvanized clamps 238, 248, 258, 268, 278 and 288 respectively around the poles of a field irrigation tower 252, 256 and 254. As further shown in two hexagonal bolts of each of the six double bolted galvanized clamps 213, 215, 217, 219, 223, 225, 227, 229, 233, 235, 237 and 239, each hexagonal bolt preferably passes through a ½ inch flat washer and a ½ inch locking washer and is secured by a ½ inch hexagonal nut. Also shown in FIG. 2, preferably, there may be a span of 4⅝ inches from the top edge of the bracing framework and the bottom edge of the bracing framework as measured through the two double-bolted clamps securing each leg of the field irrigation tower 295.

Figure 3:
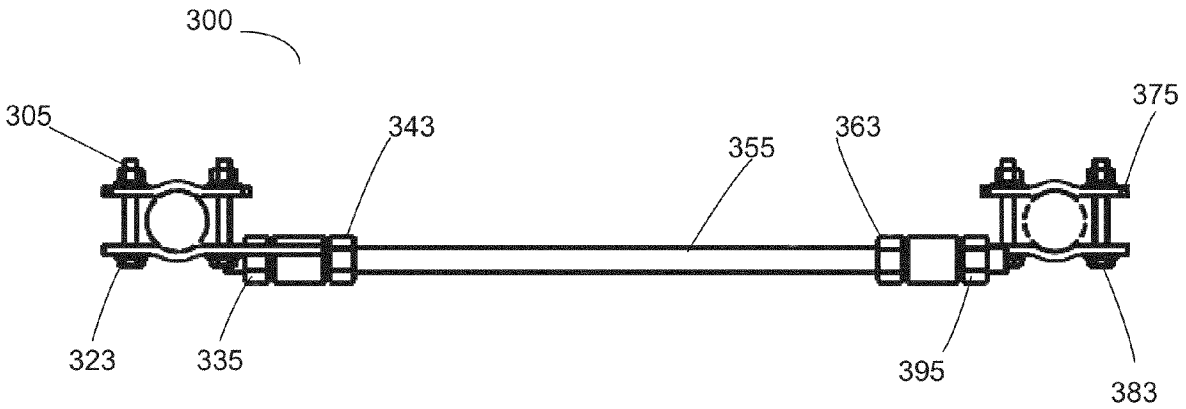
FIG. 3 illustrates a top view of a single side of the adjustable bolt-on brace assembly of the present invention.

With reference now to FIG. 3, a top view of a single side of the adjustable bolt-on brace assembly of the present invention will now be discussed. As shown in FIG. 3, a single threaded rod 355 of the brace assembly wherein each the two adjusting screws 335, 343, 363 and 395 of the threaded rod 355 are preferably secured by a ¾ inch hexagonal nut and a ¾ inch lock washer. As further shown in FIG. 3, the galvanized clamp of the threaded rod 323 and 383 double bolted to a second clamp 305 and 375.

Figure 4:
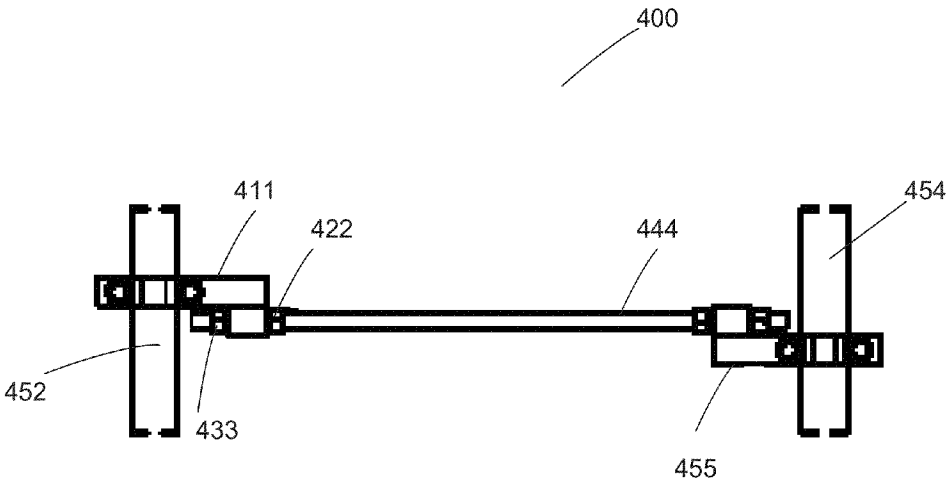
FIG. 4 illustrates a cross-sectional view along the line A-A of FIG. 1 which shows an adjustable bolt-on-brace assembly of the present invention.

With reference now to FIG. 4, a cross-sectional view of an adjustable bolt-on-brace assembly of the present invention along the line A-A of FIG. 1 will now be discussed. As shown in FIG. 4, the front rod 444 of the brace assembly as shown in plane A-A 400 includes the two legs 452 and 454 of the tripod field irrigation tower as each leg runs perpendicularly through each 1 and ¼ inch weldment brackets 411 and 455. As further shown in FIG. 4, the two adjusting screws of the threaded rod are secured by a ¾ inch hexagonal nut and a ¾ inch lock washer 433, 422. According to preferred aspects of the present invention, the diameter of the threaded rods 444 may preferably be in the range of ¾-1 inch but may also be increased to a beyond a 1-inch diameter as required by the diameter and tensile strength of the weight bearing legs of a field irrigation tower and the range of wind pressures the field irrigation tower may withstand.

Figure 5:
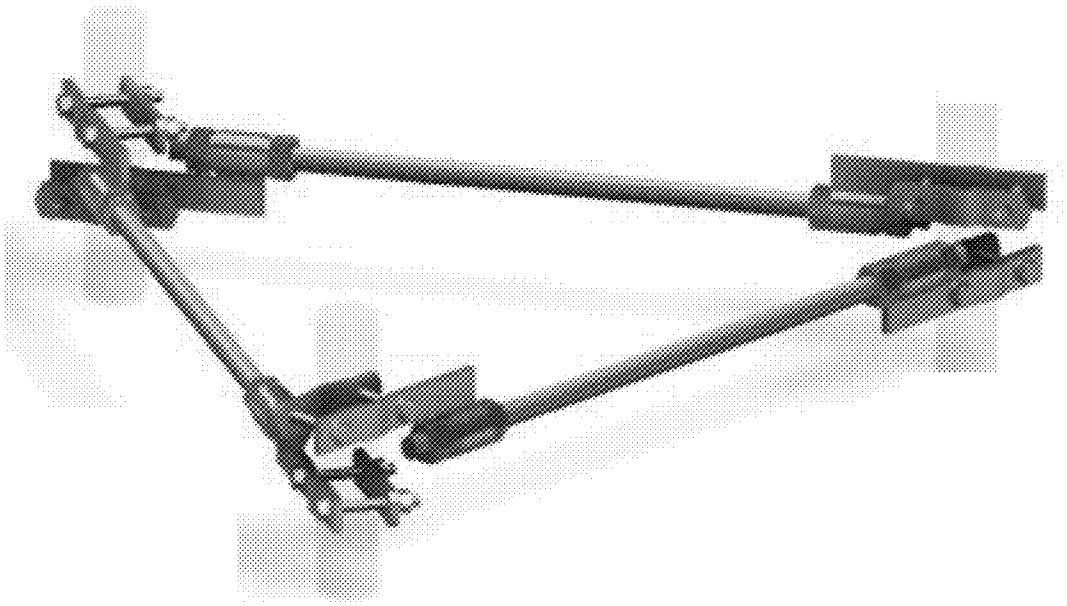
FIG. 5 illustrates a further perspective view of the adjustable bolt-on brace assembly of the present invention.

FIG. 5 illustrates a further exemplary perspective view of the adjustable bolt-on brace assembly of the present invention. Further, additional CAD and promotional images are attached to the present specification and are incorporated in their entirety by reference herein.

Unless the context clearly requires otherwise, throughout the description and the claims, the words 'comprise,' 'comprising,' and the like are to be construed in an inclusive sense as opposed to an exclusive or exhaustive sense, that is to say, in a sense of 'including, but not limited to.' Words using the singular or plural number also include the plural or singular number respectively. Additionally, the words, 'herein,' hereunder, "above," 'below,' and words of similar import refer to this application as a whole and not to any particular portions of this application. When the word 'or' is used in reference to a list of two or more items, that word covers all of the following interpretations of the word: any of the items in the list, all of the items in the list and any combinations of the items in the list.

The above description of illustrated embodiments of the systems and methods is not intended to be exhaustive or to limit the systems and methods to the precise form disclosed. While specific embodiments of, and examples for, the systems and methods are described herein for illustrative purposes, various equivalent modifications are possible within the scope of the systems and methods, as those skilled in the relevant art will recognize. The teachings of the systems and methods provided herein can be applied to other processing systems and methods, not only for the systems and methods described above.

The elements and acts of the various embodiments described above can be combined to provide further embodiments. These and other changes can be made to the system and methods in light of the above detailed description.

In general, in the following claims, the terms used should not be construed to limit the systems and methods to the specific embodiments disclosed in the specification and the claims, but should be construed to include all processing systems that operate under the claims. Accordingly, the systems and methods are not limited by the disclosure, but instead the scope of the systems and methods is to be determined entirely by the claims.

While certain aspects of the systems and methods are presented below in certain claim forms, the inventor contemplates the various aspects of the systems and methods in any number of claim forms. Accordingly, the inventor reserves the right to add additional claims after filing the application to pursue such additional claim forms for other aspects of the systems and methods.

What is claimed is:

1. An apparatus for stabilizing a field irrigation tower, wherein the apparatus comprises three threaded rods with double-bolted clamps configured to form an adjustable collar around the legs of the field irrigation tower, the apparatus comprising:

a first threaded rod having a proximal end and a distal end; wherein the proximal end of the first threaded rod comprises a first galvanized clamp; wherein the first galvanized claim is comprised of a pair of wall clamp members adjustably attached by at least two clamp securing bolts; further wherein the distal end comprises a second galvanized clamp; wherein the second galvanized claim is comprised of a pair of wall clamp members adjustably attached with at least two clamp securing bolts; wherein the first galvanized clamp is substantially parallel to the main axis of the first threaded rod; wherein the second galvanized clamp is substantially parallel to the main axis of the first threaded rod;

a second threaded rod having a proximal end and a distal end; wherein the proximal end of the second threaded rod comprises a third galvanized clamp; wherein the third galvanized claim is comprised of a pair of wall clamp members adjustably attached by at least two clamp securing bolts; further wherein the distal end comprises a fourth galvanized clamp; wherein the fourth galvanized claim is comprised of a pair of wall clamp members adjustably attached with at least two clamp securing bolts; wherein the third galvanized clamp is substantially parallel to the main axis of the second threaded rod; wherein the fourth galvanized clamp is aligned to create a sixty degree angle between the main axis of the fourth galvanized clamp and the main axis of the second threaded rod; and a third threaded rod having a proximal end and a distal end; wherein the proximal end of the third threaded rod comprises a fifth galvanized clamp; wherein the fifth galvanized claim is comprised of a pair of wall clamp members adjustably attached by at least two clamp securing bolts; further wherein the distal end comprises a sixth galvanized clamp; wherein the sixth galvanized claim is comprised of a pair of wall clamp members adjustably attached with at least two clamp securing bolts; wherein the fifth galvanized clamp is substantially parallel to the main axis of the third threaded rod; wherein the sixth galvanized clamp is aligned to create a sixty degree angle between the main axis of the fourth galvanized clamp and the main axis of the third threaded rod.

* * * * *